United States Patent [19]

Mitjans

[11] 3,992,058

[45] Nov. 16, 1976

[54] ADJUSTABLE ARMCHAIRS FOR THEATRES OR THE LIKE

[76] Inventor: Jose Figueras Mitjans, Calle Muntaner, 515, Barcelona, Spain

[22] Filed: Apr. 9, 1975

[21] Appl. No.: 566,330

[52] U.S. Cl. ..... 297/422

[51] Int. Cl.[2] ..... A47C 1/12

[58] Field of Search ..... 297/411, 412, 422, 450, 297/418, 416, 413

[56] References Cited

UNITED STATES PATENTS

| | | | |
|---|---|---|---|
| 2,538,733 | 1/1951 | Morgan et al. | 297/450 |
| 2,646,841 | 7/1953 | Sellers | 297/422 |
| 3,215,470 | 11/1965 | Swenson et al. | 297/418 X |
| 3,474,993 | 10/1969 | Murcott | 297/411 X |

FOREIGN PATENTS OR APPLICATIONS

| | | | |
|---|---|---|---|
| 156,602 | 5/1954 | Australia | 297/450 |

*Primary Examiner*—James T. McCall
*Attorney, Agent, or Firm*—Steinberg and Blake

[57] ABSTRACT

An armchair construction adapted to be used in a theatre or the like which has a floor, a portion of which extends at a given angle with respect to a horizontal plane. The armchair includes a side unit having an upper edge region forming an arm for the armchair. An elongated extension is fixed to the side unit at an inner surface thereof and extends downwardly from a portion of the side unit. A base is fixed to the above portion of the theatre floor and has an extension fixed to and extending upwardly therefrom. By way of a suitable fixing structure the extension which extends downwardly from the side unit is adjustably fixed to the extension extending upwardly from the base in a position overlapping extension to a selected extent with both of the extensions cooperating to provide for the side unit at its upper edge region, and thus at the arm of the armchair, a selected angle with respect to a horizontal plane, irrespective of the angle of the portion of the floor to which the base is fixed, in accordance with the selected extent of overlap of the extensions.

6 Claims, 3 Drawing Figures

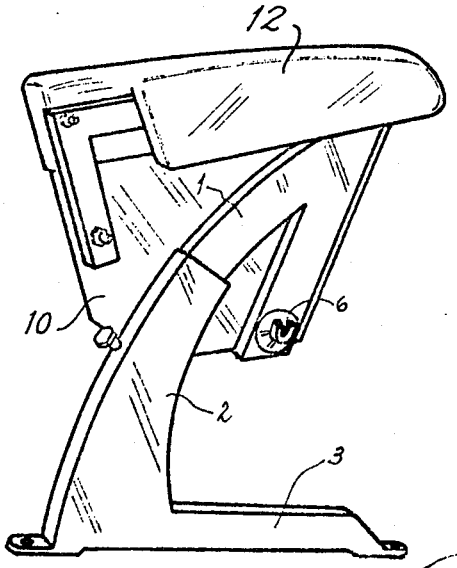
FIG. 1
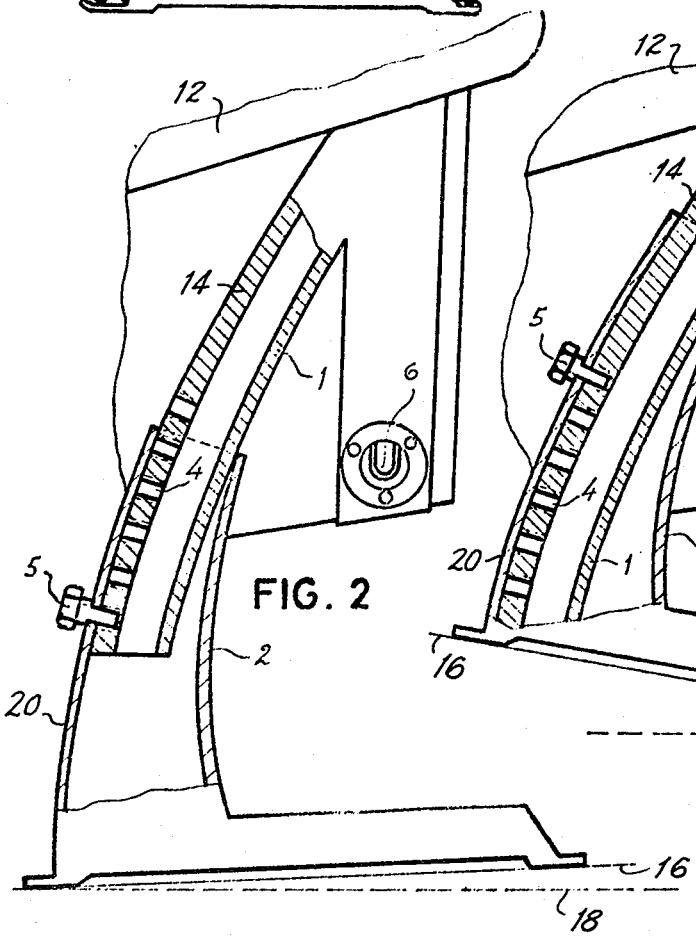
FIG. 2
FIG. 3
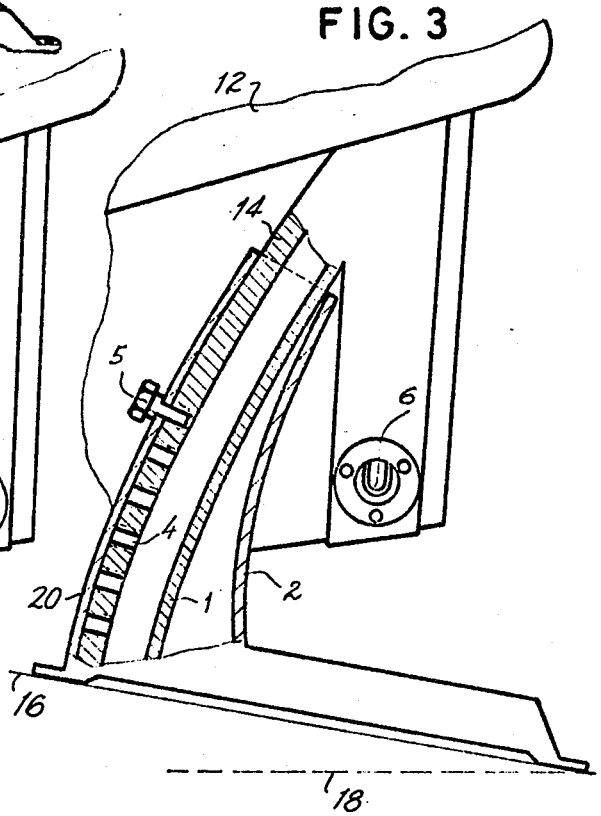

ADJUSTABLE ARMCHAIRS FOR THEATRES OR THE LIKE

BACKGROUND OF THE INVENTION

The present invention relates to adjustable armchairs particularly of the type which are adapted to be used in theatres and the like.

As is well known, theatres, lecture halls, auditoriums of all types, and the like, have floors which are not necessarily situated in a horizontal plane throughout their entire area. For example, it is common to provide for the floor of such a theatre or the like a slope which extends downwardly toward the rear at the front region of the floor which is adjacent the stage or screen, in the case of a motion picture theatre, while the rear part of the theatre will have a floor portion which slopes downwardly toward the front of the theatre, and of course the balcony of the theatre, if it has a balcony, will generally slope downwardly toward the front of the balcony.

These different slopes for the floor of theatres or the like create problems with respect to the armchairs which are situated in rows one behind the other for accommodating the audience. It is necessary to construct armchairs of this type in such a way that they will compensate for the slope of the floor to which the chair is fastened, so that in this way the individual occupying the chair will not be uncomfortably tilted rearwardly or forwardly while at the same time the arms of the individual can comfortably rest on arms of the armchair which are situated at a comfortable angle for the individual, with respect to a horizontal plane.

Because of the above factors conventional chairs of the above type are expensive inasmuch as they must be specially designed for the particular slope of the floor to which the chairs are fastened. At the present time it is common to calculate the average slope of a region of such a floor and to provide armchairs of particular dimensions for such an average slope, while armchairs of other dimensions are provided for regions of the floor which have slopes which differ sharply from the latter average slope. Thus, this necessity of providing armchairs of different dimensions and different constructions for different parts of the theatre renders the armchairs quite expensive. Moreover, a considerable installation cost is involved because of the care which must be exercised in situating properly dimensioned armchairs at the sloping floor regions for which the particular armchairs were intended.

SUMMARY OF THE INVENTION

It is accordingly a primary object of the present invention to provide an armchair construction which will avoid the above drawbacks.

Thus, it is an object of the present invention to provide an armchair construction which can readily be adjusted so as to compensate for the slope of the floor to which the armchair is fixed while at the same time enabling the same armchair construction to be used irrespective of the slope of the floor to which the armchair is fixed.

Furthermore, it is an object of the invention to provide a construction of the above type which is relatively simple and easy as well as economical to manufacture, while at the same time being easy to manipulate and adjust for providing for the arms of the armchair a preselected angle irrespective of the particular angle of slope of the floor to which the armchair is fixed.

According to the invention the armchair includes a side unit having an upper edge region forming an arm for the armchair, this side unit having an inner surface. An elongated extension means is fixed to the inner surface of the side unit and extends downwardly from a portion thereof. A base means is adapted to be fixed to a portion of the theatre floor which may have any slope with respect to a horizontal plane. An extension means is also fixed to this base means and extends upwardly therefrom. A fixing means is operatively connected with both of the above extension means for adjustably fixing them to each other with the extension means which extends downwardly from the above portion of the side unit being fixed to the extension means which extends upwardly from the base means with a selected extent of overlap with respect thereto. The pair of extension means cooperate with each other to provide, in accordance with the selected extent of overlap thereof, for the arm at the upper edge region of the side unit a selected angle with respect to the horizontal plane irrespective of the angle of the portion of the floor, with respect to a horizontal plane, to which the base means is fixed.

BRIEF DESCRIPTION OF DRAWINGS

The invention is illustated by way of example in the accompanying drawings which form part of this application and in which:

FIG. 1 is a perspective view of that part of an armchair which includes the structure of the invention;

FIG. 2 is a fragmentary elevation, at an enlarged scale as compared to FIG. 1, illustrating in section details of the structure of the invention and showing the chair of the invention in one adjusted position; and FIG. 3 is a partly sectional elevation fragmentarily illustrating the structure of FIG. 2 in a different position of adjustment.

DESCRIPTION OF PREFERRED EMBODIMENT

Referring now to FIG. 1, there is illustrated therein a side unit 10 of part of an armchair having the structure of the invention. This side unit 10 has an upper edge region forming an arm 12 for the armchair. The side unit 10 has an inner surface which is visible in FIG. 1. Fixed to the inner surface of the unit 10 is an elongated extension means 1 which has the hollow tubular construction clearly apparent from FIGS. 2 and 3. The elongated extension means 1 has an upper region which is fixed directly to a portion of the side unit 10 while from its upper region the elongated extension means extends downwardly while being spaced from the inner surface of the side unit 10 for a purpose referred to below. It will be noted from the drawings that the elongated extension means 1 is curved. As is apparent from FIGS. 2 and 3 this elongated extension means 1 has a substantially uniform cross section along the part thereof which extends downwardly from the portion fixed to the unit 10, and at least the front wall portion 14 of the extension means 1 extends along an arc of a circle whose center is situated well to the rear of the structure shown in the drawings, to the right of this structure, as viewed in the drawings.

The armchair structure of the invention also includes a base means 3 adapted to be fixed in any suitable way to a floor portion 16 of a theatre or the like. It will be noted from FIG. 2 that the floor portion 16 is inclined upwardly toward the rear, with respect to a horizontal plane 18 shown in dotted lines, while in FIG. 3 the floor portion 16 is inclined downwardly toward the rear with respect to the horizontal plane 18 shown in dotted lines.

A second extension means 2 is fixed to and extends upwardly from the base means 3 in the manner shown in the drawings. The base means 3 may be open at its bottom end and may form with the upwardly directed extension means 2 a single integral casting, for example. It will be noted that the extension means 2 is also curved and has a front elongated wall portion 20 which extends along an arc of the same circle as that along which the wall portion 14 extends. However, it will be seen that the elongated hollow extension means 2 has a top open end through which the extension means 1 extends telescopically into the interior of the extension means 2 with the latter having a cross section which gradually increases in a downward direction from the open top end of the extension means 2, so that the extension means largest cross-sectional dimension at the base means 3. This arrangement provides a desired stability for the structure of the invention.

The space between the inner surface of the side unit 10 and the part of the extension means 1 which extends downwardly from the upper portion thereof which is fixed to the side unit 10 is sufficiently great to receive a side wall of the hollow extension means 2, the upper portion of this side wall being shown in FIGS. 2 and 3 situated between the inner surface of the unit 10 and the extension means 1.

A fixing means is provided for adjustably fixing the pair of extension means 1 and 2 to each other with a selected extent of overlap therebetween. This fixing means includes an elongated portion of the wall 14 along which a series of threaded openings 4 are distributed while the wall 20 has a portion of the fixing means formed with a single opening adapted to be aligned with a selected one of the openings 4. The fixing means further includes a fastener 5 which may take the form of a suitable bolt adapted to extend through the opening in the wall 20 and to be threaded into a selected one of the bores or openings 4.

With the above construction it is possible very easily to fix the pair of extension means 1 and 2 to each other with a selected extent of overlap which will provide for the upper edge region or arm 12 of the side unit 10 a selected angle with respect to the horizontal plane 18 irrespective of the angle between this horizontal plane and the portion of the floor 16 to which the base means 3 is fixed. Thus, it is possible with the illustrated construction to provide for the adjustable structure of the invention either of the extreme end positions shown in FIGS. 2 and 3. It will be noted that in FIG. 2 the fastener 5 engages the lowermost opening 4 while in FIG. 3 the fastener 5 engages the uppermost opening 4. However, it will be noted from a comparison of FIGS. 2 and 3 that the upper edge region or arm 12 extends at the same angle in both adjusted positions. Thus, even through the floor 16 is inclined upwardly toward the rear in FIG. 2 and downwardly toward the rear in FIG. 3, the arm 12 has been given the same angle. By way of the fixing means of the invention the elongated curved wall portion 14 will extend along and overlap the elongated curve wall portion 20 along the entire length of the wall portion 14 which is received in the interior of the hollow tubular extension means 2, so that in this way an exceedingly stable strong construction is provided.

The upper portion of the extension means 1 which is directly fixed to the unit 10 is also directly fixed with a downwardly extending rear straight part which fixedly carries the bearing assembly 6 adapted to receive one end of a shaft or the like adapted to be fixed to the seat of the chair at a rear portion of the seat in such a way that this seat can be turned upwardly or downwardly with respect to the axis of the shaft one end of which is supported by the bearing assembly 6 which is schematically shown in the drawings.

It is thus clear that with the relatively simple, rugged, inexpensive structure of the invention it is possible to provide for the armchair of the invention an adjustment both in elevation and angle, compensating for the particular profile of the portion of the floor to which the armchair is fixed. Moreover, while it is possible with the structure of the invention easily to compensate for differences in height and inclination of various portions of the floor of the theatre, it is also possible to achieve this result with a single construction which can be situated at any part of the theatre floor.

What is claimed is:

1. In a chair for a theatre or the like having a floor a portion of which extends at a given angle with respect to a horizontal plane, a side unit having an upper edge region forming an arm for the chair and having an inner surface, elongated extension means fixed to said side unit at said inner surface thereof and extending downwardly from a portion of said unit, base means adapted to be fixed with said portion of said floor and fixedly carrying an extension means which extends upwardly from said base means, and fixing means operatively connected with both of said extension means for adjustably fixing said extension means which is fixed to said portion of said side unit to said extension means which extends upwardly from said base means in a position overlapping the latter extension means to a selected extent, said pair of extension means cooperating with each other for providing for said upper edge region of said side unit, and thus for said arm of said chair, a selected angle with respect to a horizontal plane, irrespective of the angle of said portion of said floor to which said base means is fixed, in accordance with the selected extent of overlap of said pair of said extension means, said pair of extension means both being curved at least at the portions thereof which overlap and engage each other and which are adjustably fixed to each other by said fixing means, said pair of extension means cooperating telescopically one with respect to the other, and said extension means which extends upwardly from said base means being hollow and having a top open end through which the other extension means extends into the interior of said extension means which is fixed to said base means, said pair of extension means respectively having elongated curved wall portions engaging each other, and said fixing means including a region of one of said wall portions formed with a series of openings distributed longitudinally along said region and a region of the other of said wall portions formed with an opening to be aligned with an opening of said region of said one wall portion, and a fastener situated in said opening of said other wall portion and in a selected one of said openings at said region of said one wall portion for releasably fixing the pair of extension means to each other with a selected extent of overlap.

2. The combination of claim 1 and wherein the pair of extension means are both curved along an arc of a common circle.

3. The combination of claim 2 and wherein the latter circle has a center situated to the rear of said base means and side unit.

4. The combination of claim 1 and wherein said one wall portion with said region having said plurality of openings distributed longitudinally therealong forms part of said extension means which is fixed to said side unit.

5. The combination of claim 4 and wherein said extension means which is fixed to said side unit is also in the form of a hollow tubular member.

6. The combination of claim 5 and wherein said extension means which is fixed to said side unit is of a substantially uniform cross section along its length while said extension means which extends upwardly from said base means has at said top open end an opening large enough for said extension means fixed to said side unit to extend with a relatively small clearance through the latter opening into the interior of the hollow extension means extending upwardly from said base means, and the latter extension means having a cross section which gradually increases in a downward direction with the maximum cross-sectional dimension of said extension means which extends upwardly from said base means being situated at said base means.

* * * * *